US006752195B1

(12) United States Patent
Chou

(10) Patent No.: US 6,752,195 B1
(45) Date of Patent: Jun. 22, 2004

(54) ANCHOR APPARATUS FOR CURTAIN CORD

(76) Inventor: Tser-Wen Chou, No. 212, Lane 23, Ren-Mei Tsun, Shuei-Guan Rd., Niau-Sung Hsiang, Kaohsiung Hsien (TW)

( * ) Notice: Subject to any disclaimer, the term of this patent is extended or adjusted under 35 U.S.C. 154(b) by 0 days.

(21) Appl. No.: 10/252,726

(22) Filed: Sep. 24, 2002

(51) Int. Cl.[7] ..... E06B 9/324
(52) U.S. Cl. ..... 160/178.2 R
(58) Field of Search ..... 160/178.2 R, 173 R, 160/178.1 R, 168.1 R, 243; 24/115 L, 136 A, 136 R

(56) References Cited

U.S. PATENT DOCUMENTS 2,494,759 A * 1/1950 Hirschy ..... 160/178.2 R
4,180,118 A * 12/1979 Vecchiarelli ..... 160/178.2 R
4,245,688 A * 1/1981 Vecchiarelli ..... 160/178.2 R
4,250,597 A * 2/1981 Ford et al. ..... 160/178.2 R
4,352,386 A * 10/1982 Butler et al. ..... 160/178.2 R
4,955,420 A * 9/1990 Marinescu et al. ... 160/178.2 R
5,263,528 A * 11/1993 Patel ..... 160/178.2 R

* cited by examiner

*Primary Examiner*—David Purol
(74) *Attorney, Agent, or Firm*—Birch, Stewart, Kolasch & Birch, LLP

(57) ABSTRACT

An anchor apparatus for a curtain cord is located in a U-shaped frame that has a front wall and a rear wall. The apparatus includes an anchor wheel and a brake wheel that may be closed to each other to anchor a curtain cord. The anchor wheel is an angle wheel with flat surfaces formed on the peripheral surface to match teeth traces formed on the brake wheel to control the anchoring of the curtain cord. The curtain cord is not damaged by heavy clutching and crushing when in use. Operation may be done with less effort. Compressing effect is improved and durability may be increased.

6 Claims, 10 Drawing Sheets

PRIOR. ART

ANCHOR APPARATUS FOR CURTAIN CORD

FIELD OF THE INVENTION

The present invention relates to an anchor apparatus for a curtain cord to prevent the cord from being crushed and damaged, and to facilitate operation and increase durability.

BACKGROUND OF THE INVENTION

The commonly used anchor apparatus for a curtain cord generally includes an anchor wheel and a brake wheel. The brake wheel has teeth traces on the peripheral surface and may be moved closely to the anchor wheel to clutch the curtain cord against the curved peripheral surface of the anchor wheel to anchor the curtain cord (as shown in FIG. 1). In the anchor condition set forth above, the curtain cord is crushed flatly between the brake wheel and the anchor wheel. As the curtain cord is subject to a heavy pulling force during operation, the curtain cord is prone to be damaged, and the life span of the curtain suffers. In addition, the anchor wheel usually is stationary without turning, and the curtain cord is wound around the curved peripheral surface of the anchor wheel. As a result, the curtain cord often is very tight when pulled but is difficult to unwind and release. Users often have to swing the curtain cord left and right to release the curtain cord and the curtain. Operation is troublesome and not smooth.

As the conventional anchor apparatus for the curtain cord has a stationary and tubular anchor wheel that is not able to turn, durability of the curtain cord is shorter and operation is more difficult. Moreover, the conventional anchor apparatus for the curtain cord usually are made with a fixed dimension in terms of the height. A dimensional deviation is prone to occur when adopted on curtain frames of different dimensions, and often results in wobbling of the anchor apparatus after installation. Thus anchoring is not firm or steady.

SUMMARY OF THE INVENTION

In view of the aforesaid disadvantages, the primary object of the invention is to provide an improved anchor apparatus for a curtain cord that can be operated smoothly with less effort and can increase the durability, and also is adaptable to curtain frames of different dimensions.

The anchor apparatus of the invention includes a turnable anchor wheel formed in an angle wheel with a plurality of flat surfaces, and a brake wheel which may be moved closely to the anchor wheel to compress the curtain cord such that the curtain cord is bent and press against the angular sides of the anchor wheel to form a secured anchoring. As the curtain cord is anchored on a bent condition to receive forces, the angle wheel can absorb the forces completely. The curtain cord is not crushed flatly even if the brake wheel is moved closely to the anchor wheel. Thus the curtain cord is less likely to be damaged and its durability can increase. In addition, the anchor wheel is able to turn and has flat peripheral surfaces. When the curtain cord is pulled, the anchor wheel may be turned to present a flat surface space, thus can be unwound and released rapidly to lower the curtain.

The foregoing, as well as additional objects, features and advantages of the invention will be more readily apparent from the following detailed description, which proceeds with reference to the accompanying drawings.

DESCRIPTION OF THE PREFERRED EMBODIMENTS

Figure 1:
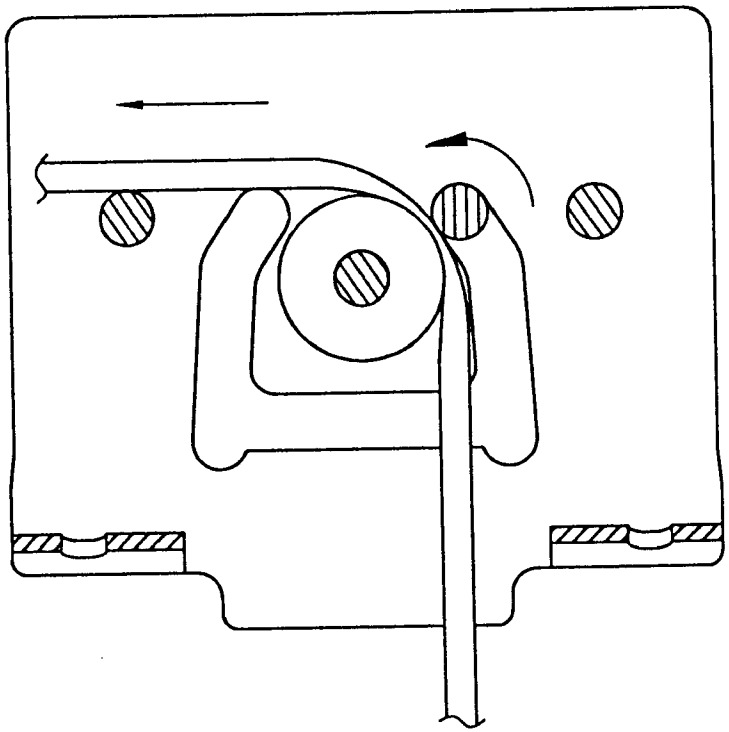
FIG. 1 is a schematic view of a conventional anchor apparatus for a curtain cord, with the brake wheel crushing the curtain cord.
Figure 2:
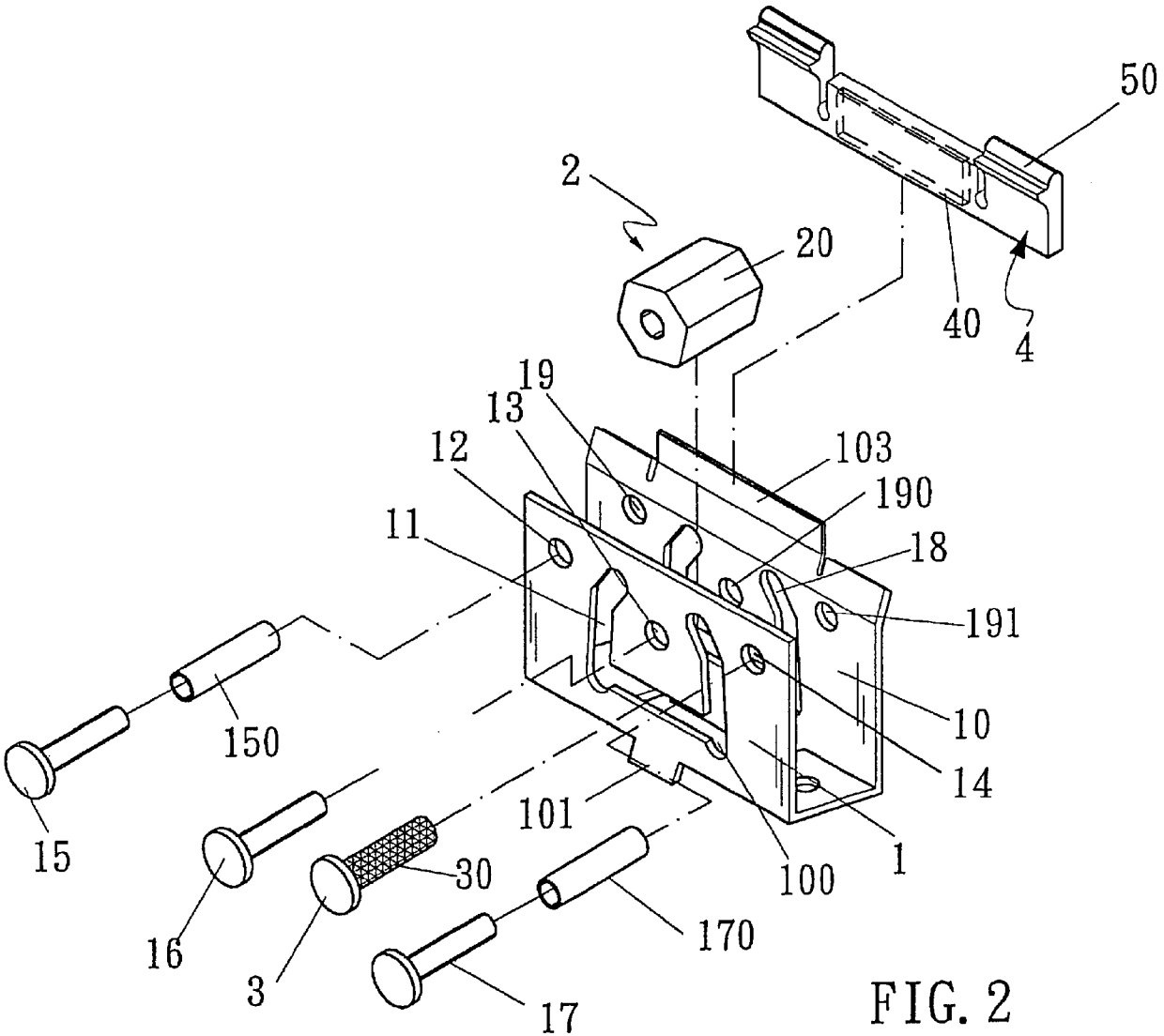
FIG. 2 is an exploded view of the invention.
Figure 3:
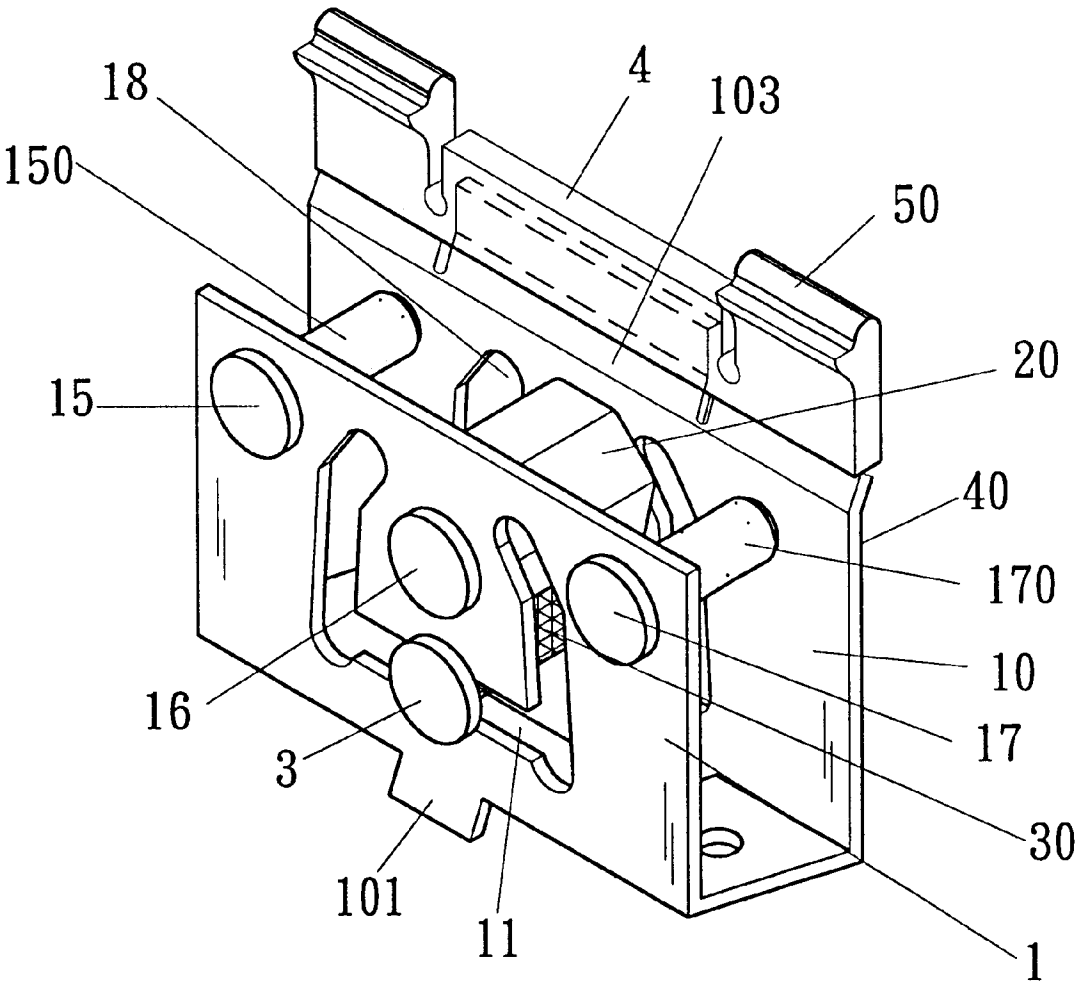
FIG. 3 is a perspective view of the invention.

Referring to FIGS. 2 and 3, the anchor apparatus of the invention includes a U-shaped frame that has a front wall 1 and a rear wall 10, and a lower section with an opening 100 formed thereon to allow a curtain cord to pass through. The front wall 1 has a front wedge ledge 101 extended downwards from a lower edge, and a front retain slot 11, a first front anchor hole 12, a second front anchor hole 13 and a third front anchor hole 14 to enable a brake wheel 3, a first rivet 15, a second rivet 16 and a third rivet 17 to run through respectively to engage with a rear retain slot 18, a first rear anchor hole 19, a second rear anchor hole 190 and a third rear anchor hole 191 formed on the rear wall 10. The brake wheel 3 has teeth traces 30 formed on the peripheral surface thereof and is movable in the front retain slot 11. The rivets 15, 16 and 17 are coupled respectively with a first roller 150, an anchor wheel 2, and a second roller 170. The anchor wheel 2 has flat surfaces 20 formed on the peripheral surface thereof.

Figure 4:
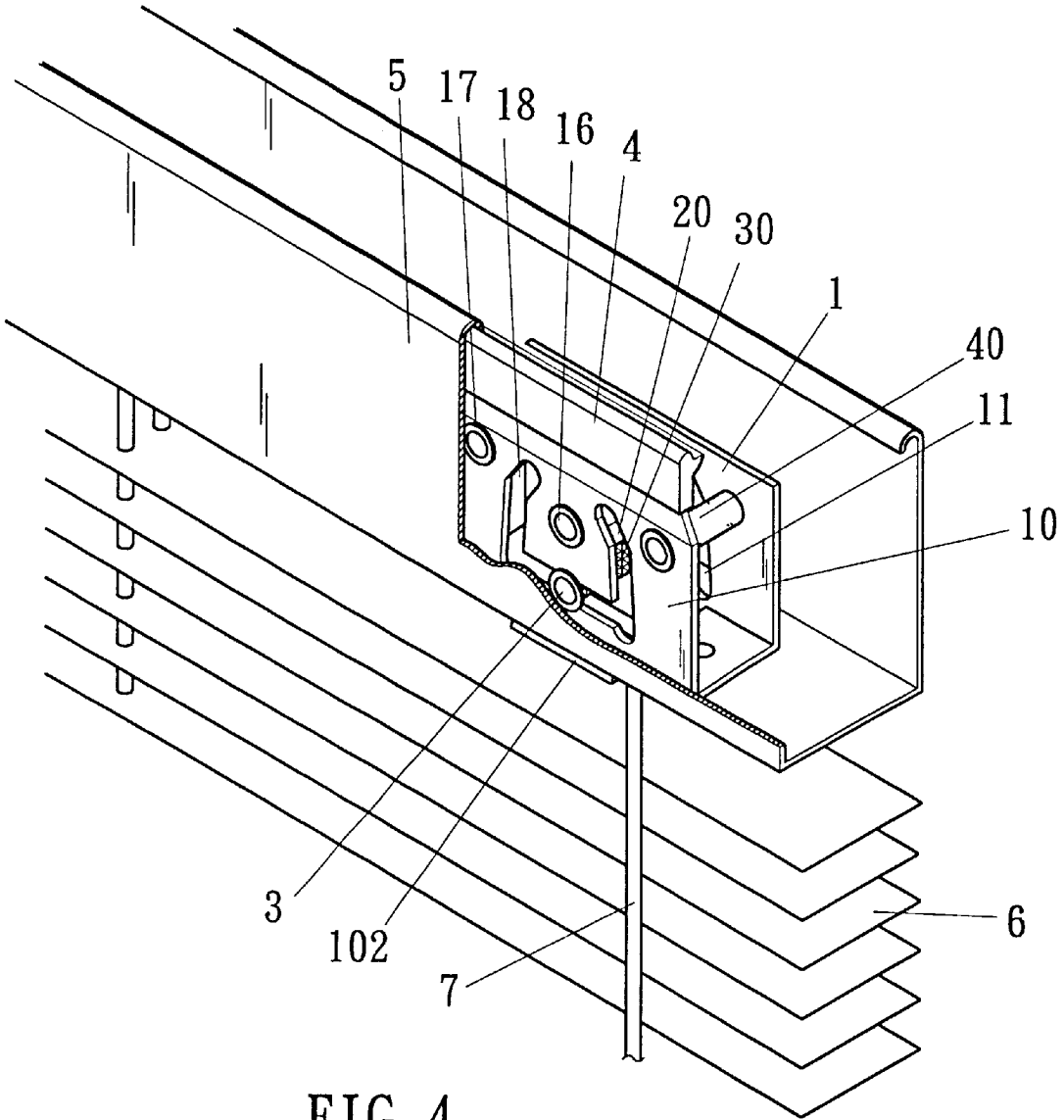
FIG. 4 is a schematic view of the invention in use.
Figure 5:
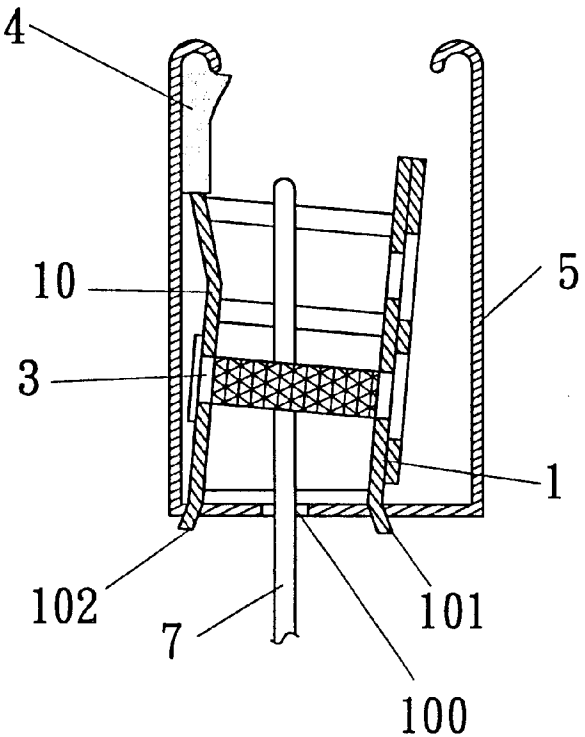
FIG. 5 is a sectional view of the invention in an installed condition.

The rear wall 10 has a rear wedge ledge 102 extended downwards from a lower edge thereof (as shown in FIG. 5) and a wedge flange 103 formed on an upper edge to couple with a movable support member 4. The support member 4 has an upper end to form two wedge elements 50 at two sides to match a window frame 5, and a latch groove 40 formed on a lower side thereof to couple with the wedge flange 103 of the rear wall 10. The support member 4 may be engaged with the window frame 5 with the rear wedge ledge 102 wedged in a slot 51 formed on the window frame 5 to fasten the anchor apparatus firmly on the window frame 5 so that the curtain cord 7 for the curtain panels 6 may be anchored thereon (as shown in FIGS. 4 and 5).

Figure 6:
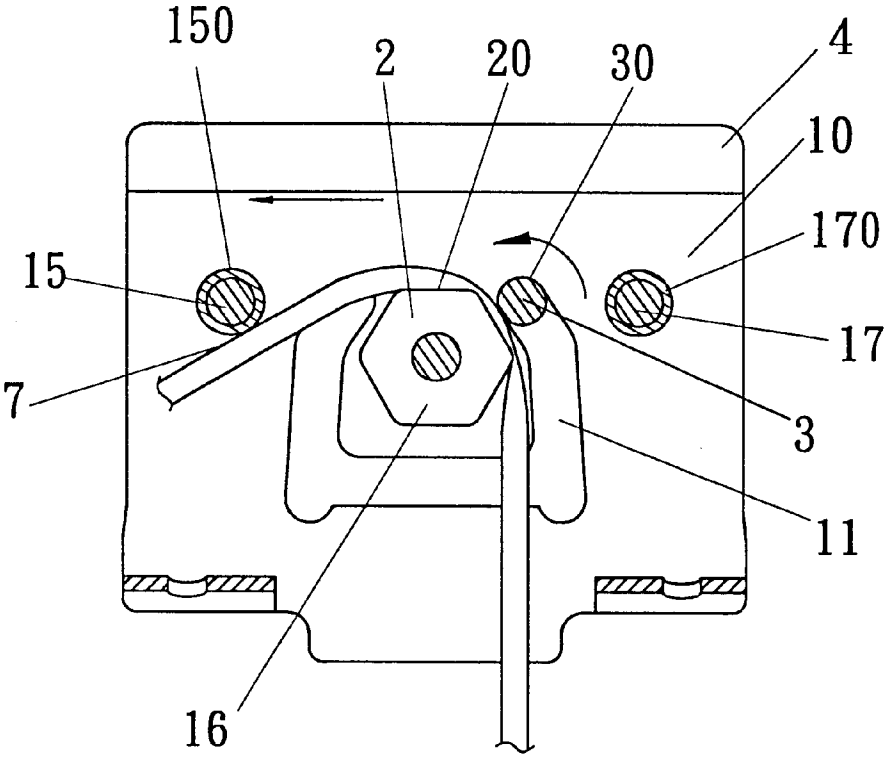
FIG. 6 is a schematic view of the invention, with the curtain cord being compressed.
Figure 7:
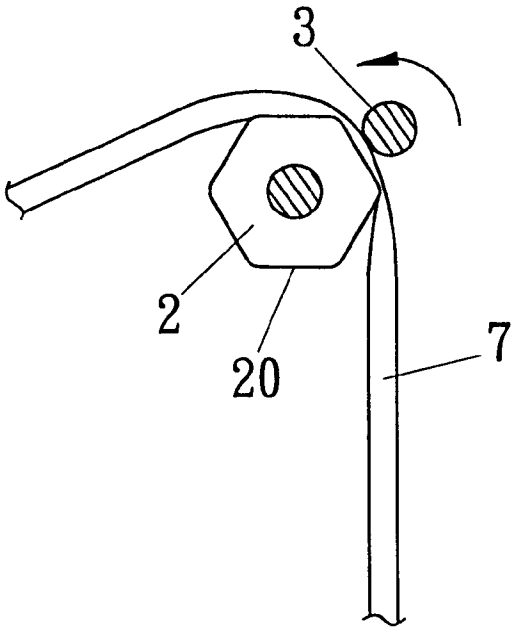
FIG. 7 is a fragmentary schematic view of the invention, with the brake wheel compressing the curtain cord.

Referring to FIGS. 6 and 7, when to lift the curtain panels 6, pull the curtain cord 7 downwards. The first roller 150 enables the curtain cord 7 to be moved smoothly with less effort. The brake wheel 3 is guided and channeled by, the front retain slot 11 and moved upwards to close to the anchor wheel 2. Because of the angle wheel design of the anchor wheel 2, the curtain cord is bent and anchored at the angled surface to create a one-way anchoring effect. Coupled with the compression of the teeth traces 30 of the brake wheel 3, the curtain cord may be anchored securely.

Figure 8:
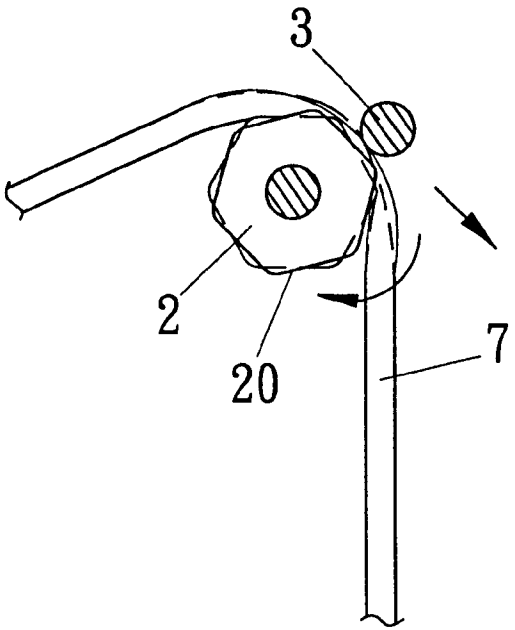
FIG. 8 is a fragmentary schematic view of the invention, with the curtain cord released.

Referring to FIG. 8, when to lower the curtain panels 6, pull the curtain cord 7 downwards. The anchor wheel 2 is subject to the pulling force and turns the plane surface of another side to enable the curtain cord be pulled tightly to create a space for releasing, thus the brake wheel 3 moves downwards and the curtain panels may be lowered.

Figure 10:
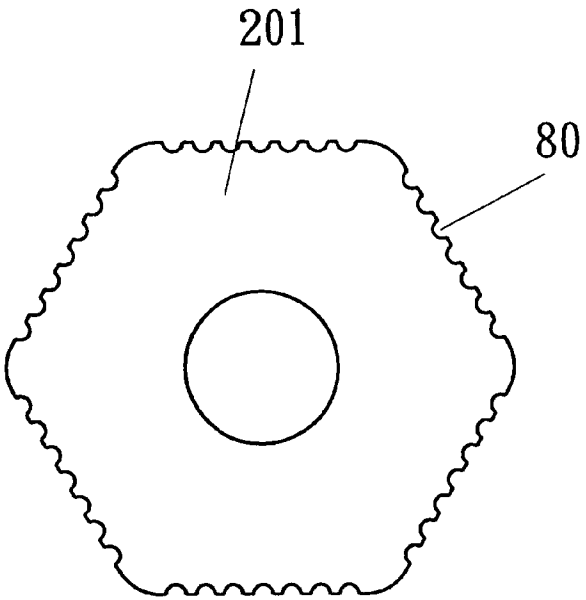
FIG. 10 is a front view of yet another embodiment of the anchor wheel of the invention.
Figure 9:
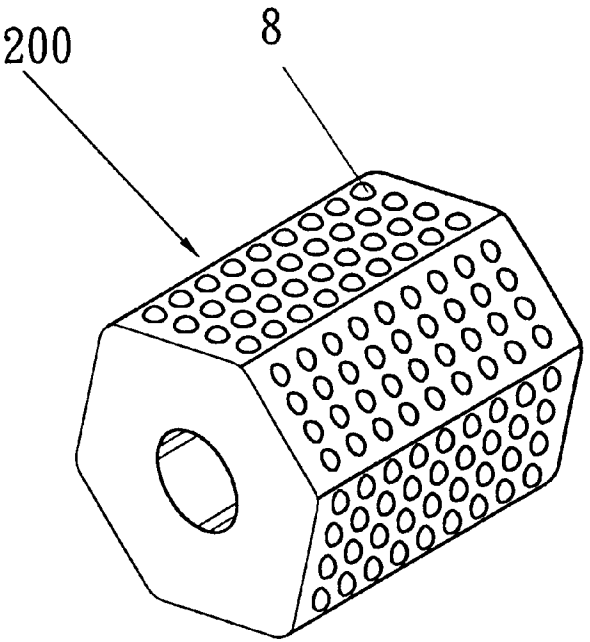
FIG. 9 is a perspective view of another embodiment of the anchor wheel of the invention.
Figure 11:
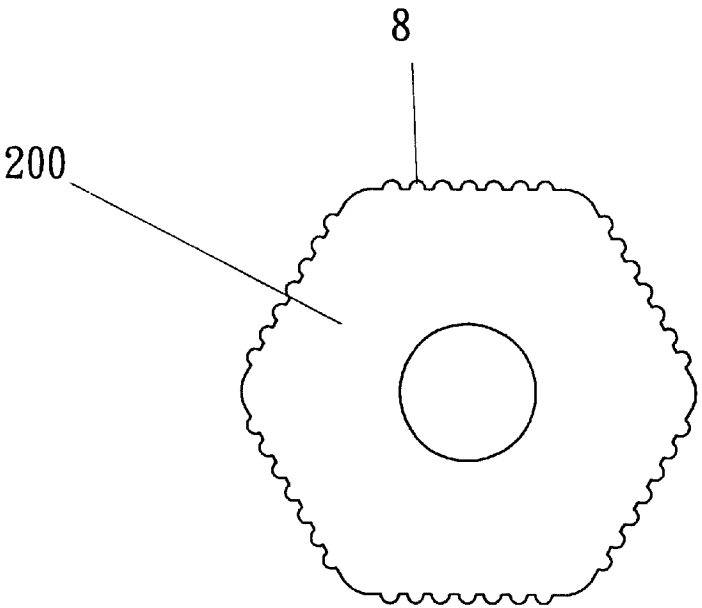
FIG. 11 is a front view of still another embodiment of the anchor wheel of the invention.

Refer to FIGS. 9, 10 and 11 for various embodiments of the anchor wheels 200 and 201 that have bulged spots 8 and grooves 80 formed on the peripheral surface to suit the curtain cords of different sizes.

Figure 12:
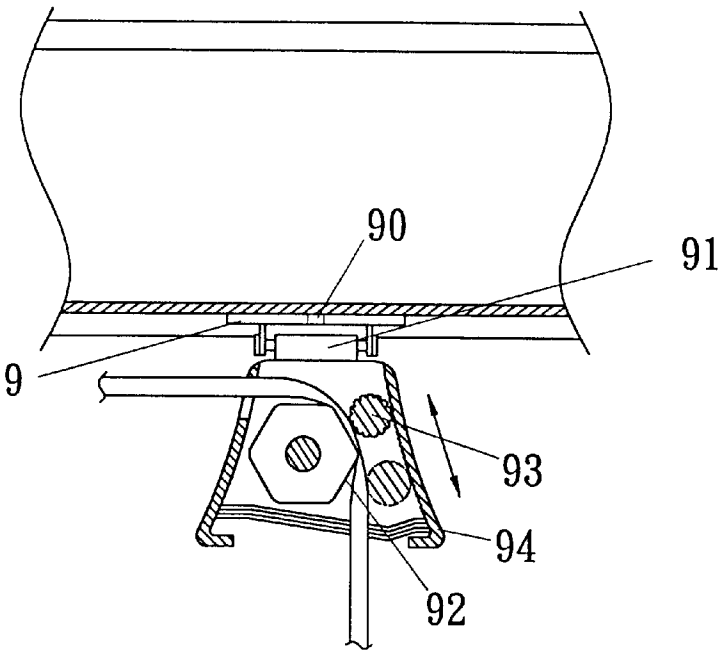
FIG. 12 is a schematic cross section of the anchor wheel of the invention in a practical use condition.
Figure 13:
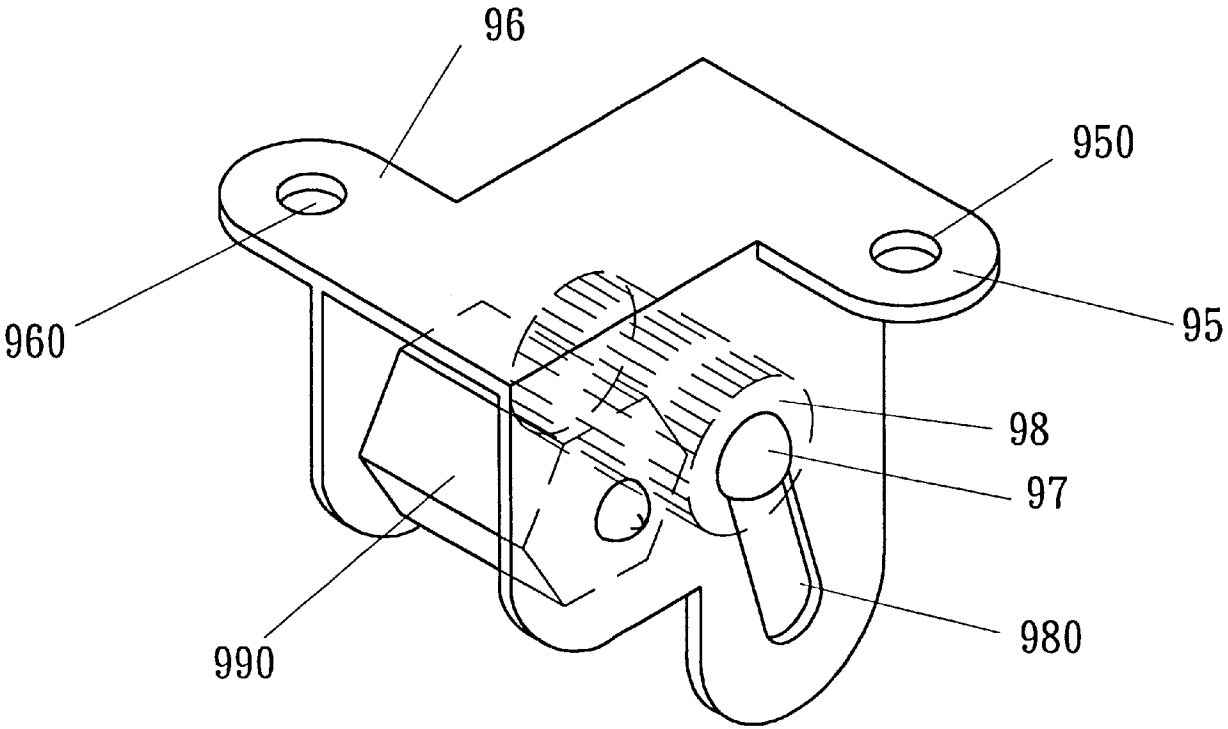
FIG. 13 is a schematic view of the invention in another practical use condition.

The anchor apparatus of the invention may also be adopted for bamboo curtain panels. Referring to FIGS. 12 and 13, at the upper section of the anchor apparatus, there is a movable fastening plate 9 which has a screw hole 90. The main body of the anchor apparatus is coupled with a movable turning shaft 91. The main body contains an anchor wheel 92 and a brake wheel 93. On the inner surface of the main body, there are teeth 94 formed thereon to match the teeth of the brake wheel 93 to compress the anchor wheel 92 when moving upward to achieve the anchoring effect.

Figure 14:
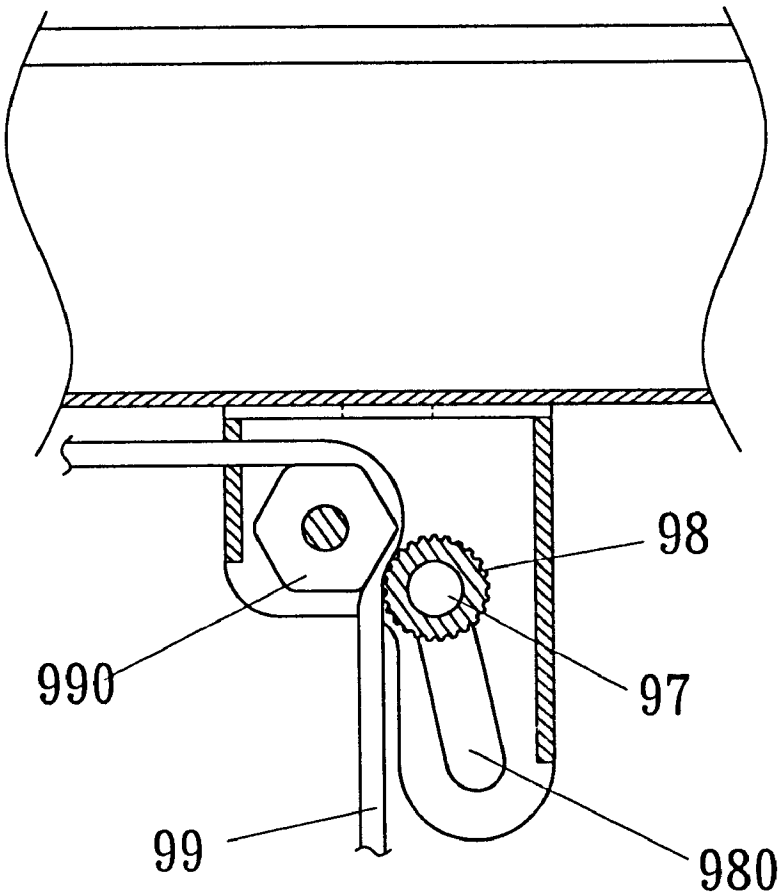
FIG. 14 is a schematic cross section according to FIG. 13.

FIG. 13 illustrates another embodiment of the anchor apparatus that has two lugs 95 and 96 located on two sides of a main body with a screw hole 950 and 960 formed respectively thereon. The main body has a guiding slot 980. The brake wheel 98 has a shaft 97 coupling in the guiding slot 980. When the curtain cord 99 is pulled, the brake wheel 98 may be moved upwards to compress the anchor wheel 990 to achieve the anchoring effect (as shown in FIG. 14).

In summary the invention can achieve the following functions and effects:

1. The curtain cord of the invention is bent by the angular peripheral sides of the anchor wheel and is compressed by the brake wheel for anchoring rather than being clutched and crushed by the teeth traces of the brake wheel, hence the curtain cord is not damaged and may last longer.
2. The anchor wheel that has flat peripheral surfaces on an angle wheel is able to turn, thus enables the brake wheel to have space alteration during operation and switch from a tight condition to a loose condition quickly. Operation is smoother and requires less effort.
3. The invention may be adapted to various curtain frames. The movable support member can be fastened firmly to the curtain frames, and the height of the support member may be altered to suit different curtain frame dimensions.
4. The rivets of the invention are coupled with movable rollers that can reduce friction force of the curtain cord and save operation effort.
5. The coupling structure of the anchor wheel and the brake wheel of the invention can be adopted for anchoring curtain cords used in other types of fabric curtains or bamboo curtains.
6. The number of angle and flat surfaces on the anchor wheel may be changed according to the size of the curtain cord to form different combinations and assemblies.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An anchor apparatus for a curtain cord, comprising:

an U-shaped frame having a front wall and a rear wall, the front wall having a front retain slot, a first front anchor hole, a second front anchor hole and a third front anchor hole formed thereon corresponding to a rear retain slot, a first rear anchor hole, a second rear anchor hole and a third rear anchor hole formed on the rear wall, the first front anchor hole, the second front anchor hole and the third front anchor hole being coupled respectively with the first rear anchor hole, the second rear anchor hole and the third rear anchor hole by means of a first rivet, a second rivet and a third rivet, the first rivet and the third rivet being coupled respectively with a movable first roller and a movable second roller, the rear wall having wedge flanges;

an anchor wheel coupled with the second rivet which engages with second front anchor hole and the second rear anchor hole between the front wall and the rear wall;

a brake wheel engaged with and movable in the front retain slot and the rear retain slot between the front wall and the rear wall; and a support member having an upper end to form two wedge elements at two sides thereof to match a window frame, and a latch groove formed on a lower side thereof to couple with the wedge flange of the rear wall.

2. The anchor apparatus for a curtain cord of claim 1, wherein the U-shaped frame has a lower section between the front wall and the rear wall with an opening formed thereon to allow the curtain cord to pass through, the front wall and the rear wall having respectively a front wedge ledge and a rear wedge ledge extended downwards from a lower edge thereof to latch on a slot formed on the window frame to fasten the anchor apparatus firmly on one side of the window frame.

3. The anchor apparatus for a curtain cord of claim 1, wherein the anchor wheel with flat surfaces formed on the peripheral surface thereof.

4. The anchor apparatus for a curtain cord of claim 1, wherein the brake wheel has teeth traces formed on the peripheral surface thereof and is movable upwards under the guiding of the front retain slot and the rear retain slot to close to the anchor wheel to compress the curtain cord on a flat surface for anchoring.

5. The anchor apparatus for a curtain cord of claim 1, wherein the anchor wheel has flat surfaces with bulged spots formed thereon.

6. The anchor apparatus for a curtain cord of claim 1, wherein the anchor wheel has flat surfaces with grooves formed thereon.

* * * * *